United States Patent [19]

Gambacorta

[11] 4,194,901

[45] Mar. 25, 1980

[54] PROCESS FOR PRODUCING GRAPHITE AGGLOMERATES, AND PRODUCTS OBTAINED BY IT

[75] Inventor: Mario Gambacorta, Ancona, Italy

[73] Assignee: S.I.A.P. Societa Industriale Agglomerati e Prodotti Petroliferi S.p.A., Venezia-Mestre, Italy

[21] Appl. No.: 884,218

[22] Filed: Mar. 7, 1978

Related U.S. Application Data

[63] Continuation of Ser. No. 696,365, Jun. 15, 1976, abandoned.

[30] Foreign Application Priority Data

Jun. 23, 1975 [IT] Italy ..... 615 A/75

[51] Int. Cl.[2] ..... C21C 7/00

[52] U.S. Cl. ..... 75/48; 75/130 R

[58] Field of Search ..... 75/48, 130 R

[56] References Cited

U.S. PATENT DOCUMENTS

| | | | |
|---|---|---|---|
| 2,365,055 | 12/1944 | Cole | 264/117 |
| 2,527,829 | 10/1950 | Leitten | 75/48 X |
| 2,540,173 | 2/1951 | Olivo | 75/130 R |
| 3,077,439 | 2/1963 | Shea, Jr. et al. | 264/117 X |
| 3,368,012 | 2/1968 | Erickson | 264/117 |

FOREIGN PATENT DOCUMENTS

| | | | |
|---|---|---|---|
| 437994 | 11/1935 | United Kingdom | 75/48 |
| 1070627 | 6/1967 | United Kingdom | 75/48 |

*Primary Examiner*—M. J. Andrews

*Attorney, Agent, or Firm*—Cushman, Darby & Cushman

[57] ABSTRACT

A process for producing graphitic agglomerates, comprising the steps of: mixing together in a suitable mixer a very fine graphitic powder, a coal such as anthracite, pitcoal, coke etc., and a binder such as coal tar pitch, starch, lignan and its derivatives such as lignin-sulphonates etc., thermoplastic and thermosetting resins; heating this mixture to about the melting temperature of the binder; and feeding the amalgamated mixture into a moulding press in which it is solidified into ovoid shapes, briquets and the like, or feeding it into a pelletizing plant.

4 Claims, No Drawings

PROCESS FOR PRODUCING GRAPHITE AGGLOMERATES, AND PRODUCTS OBTAINED BY IT

This is a continuation of application Ser. No. 696,365 filed June 15, 1976 now abandoned.

This invention relates to the production of graphitic agglomerates to be used in the production of steel in open-hearth furnaces and in arc and induction furnaces as well as in the production of cast iron in arc and induction furnaces and in rotary and neverberatory furnaces.

The utilisation of graphitic dusts, which are collected in the various production steps of graphite electrodes, electrode pastes, graphite anodes etc., or which are formed by milling scraps of these products, is a question hitherto not solved. Indeed these very fine graphitic dusts or powders are not utilizable in practice in the form of powder, on one hand, and it is very difficult to agglomerate them, on the other hand, as they are notoriously dry lubricants, so that hitherto their agglomeration to utilisable products has never been successful.

Consequently, up to now said very fine graphitic powders were dumped into large pits, which were then covered with earth; this expedient, besides causing an economic waste, also raises ecologic problems.

Considering that said very fine graphitic powders have a carbon content from 65% to 100% and furthermore that this carbon is in the allotropic form of graphite, it is clear that a general economic advantage might be obtained by a successful agglomeration of these powders into products of an effective and easy use in metallurgic furnaces in order to increase the carbon content of steels and cast irons. The ecologic advantage so reached is equally apparent, since such an agglomerate is not only free of dust, but on the contrary very compact.

Several attempts have been made to solve the very difficult question of the agglomeration of this very fine graphitic powder by using coal tar pitch, but this required at least 30% pitch, so that the agglomerate could contain at the most 70% graphitic powders. Such high pitch percentages yielded a very hard product, whose absorption by the melting bath was difficult and which gave a low yield in dissolved carbon. Therefore this product was unsuitable for the intended purpose.

This invention solves the aforesaid problems by means of a process permitting the agglomeration of said very fine graphitic powders into suitable products for metallurgical and siderurgical use.

The invention is based on the agglomeration of said very fine graphitic powders by using suitable tar pitch percentages and adding other carbon material which is non-graphitic (anthracites, pitcoals, coke etc.); previously many prolonged attempts were made to bond together very fine graphitic powders by means of various types of binder but with unsatisfying results, because too high percentages of binder were required to obtain a well compacted product, which was also expensive and not free from harmful components. The addition of said carbons, though not necessary to successfully agglomerate very fine graphitic powders, is indispensable in order to reduce these very high percentages of the binder.

The process according to the invention comprises the steps of: mixing together in a suitable mixer a very fine graphitic powder, a non-graphitic carbon material and a binder such as tar pitch; heating this mixture to about the melting or bonding temperature of the binder (approximately 100° C. in the case of pitch with a KS of 70° C.) so as to obtain an amalgamated mixture; and feeding the amalgamated mixture into a moulding press in which it is solidified into ovoid shapes, briquets and the like, or feeding it into a pelletizing plant.

As a binder, in addition to coal tar pitch, also other materials are adopted, provided they are not detrimental to the good characteristics of the steel and are economically acceptable; examples of these materials are: starch, lignin and its derivatives (lignin-sulphonates etc.), thermoplastic and thermosetting resins. The various component percentages may range within wide limits, since they are variable as a function of the graphite contents in said powder as well as of the type of coal. However, limit percentages of the components of an exemplifying mixture are by weight:

very fine graphitic powder with 70% graphite: 10–50%
English anthracite in sizes of 0–10 mm: 80–28%
coal tar pitch, KS 70° C.: 10–22%

An indicative mean composition is the following:

very fine graphitic powder, 80% graphite: 35%
English anthracite in sizes of 0–10 mm: 50%
tar pitch, KS 70° C.: 15%

The present invention also includes all the various products obtained with the aove explained process.

What is claimed is:

1. A method of increasing the carbon content of steel and cast iron products during their production, by
   - collecting graphitic dusts resulting from production of graphite electrodes, electrode pastes or graphite anodes;
   - admixing said dusts with (1) a non-graphitic carbon material selected from the group consisting of pitcoal and coke and (2) a binder of coal tar pitch, to form an admixture;
   - heating said admixture to about the melting temperature of the binder so as to obtain an amalgamated mixture;
   - molding the amalgamated mixture to form graphite-containing agglomerates; and
   - adding said graphite-containing agglomerates to a metallurgical bath in which steel or iron is being produced,
   - wherein the non-graphitic carbon material is present in an amount sufficient to reduce the amount of binder required to form said graphite-containing agglomerates so that (a) the concentration of the binder in said agglomerate is low enough to allow dissolution of the agglomerate in said bath and (b) the concentration of the binder in said bath is the highest binder concentration which is acceptable in the ultimate steel or cast iron product.

2. The method of claim 1, wherein said graphitic dusts are dusts resulting from the milling of scraps of graphite electrodes or electrode pastes.

3. Th method according to claim 1, wherein the amalgamated mixture contains by weight (1) 10–50% graphitic powder, resulting from production of graphite electrodes, electrode pastes or graphite anodes, (2) 80–28% non-graphitic carbon material, and (3) 10–22% binder.

4. The method according to claim 3, wherein the amalgamated mixture consists of (1), (2) and (3).

* * * * *